US006634349B2

(12) United States Patent
Mizek et al.

(10) Patent No.: US 6,634,349 B2
(45) Date of Patent: Oct. 21, 2003

(54) MOVE AWAY ARROW REST

(75) Inventors: Robert S. Mizek, Downers Grove, IL (US); Frank A. Harwath, Naperville, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 09/837,665

(22) Filed: Apr. 18, 2001

(65) Prior Publication Data

US 2003/0024516 A1 Feb. 6, 2003

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 2,691,974 | A | * | 10/1954 | Nelson |
| 3,935,854 | A | | 2/1976 | Troncosco, Jr. |
| 4,715,355 | A | * | 12/1987 | Lattig |
| 5,070,855 | A | | 12/1991 | Troncoso |
| 5,179,930 | A | * | 1/1993 | Simo ..... 124/44.5 |
| 5,400,763 | A | | 3/1995 | Mazza |
| 5,490,491 | A | | 2/1996 | Troncoso |
| 5,526,800 | A | | 6/1996 | Christian |
| 5,529,049 | A | | 6/1996 | Antalosky |
| 5,606,962 | A | | 3/1997 | Troncoso |
| 5,676,121 | A | | 10/1997 | Bizier |
| 5,722,381 | A | | 3/1998 | Mizek |
| 5,960,779 | A | | 10/1999 | Jessee et al. |
| 6,035,842 | A | | 3/2000 | Bradley |
| 6,044,832 | A | | 4/2000 | Piersons, Jr. |
| 6,050,251 | A | | 4/2000 | Harwath et al. |
| 6,082,348 | A | | 7/2000 | Savage |
| 6,102,020 | A | | 8/2000 | Mizek et al. |
| 6,202,635 | B1 | | 3/2001 | Evans |

* cited by examiner

*Primary Examiner*—John A. Ricci
(74) *Attorney, Agent, or Firm*—Pauley Peterson & Erickson

(57) ABSTRACT

An apparatus for mounting an arrow rest with respect to an archery bow window. In one preferred embodiment of this invention, the apparatus includes a shaft mounted with respect to a housing, and moveable between a first position and a second position. A cam is connected to or integrated with the shaft and operatively moveable with the shaft. A follower is urged in contact with the cam in the first position by a first bias element and a second bias element urges the shaft from the first position to the second position.

37 Claims, 10 Drawing Sheets

MOVE AWAY ARROW REST

BACKGROUND OF THE INVENTION

1. Field of the Invention

This invention relates to an apparatus for mounting an arrow rest with respect to an archery bow. More specifically, this invention relates to an apparatus for mounting an arrow rest with respect to an archery bow window, whereby the arrow rest moves in response to a movement of an archery arrow, usually in a downward direction away from the archery arrow, before a fletching of the archery arrow has an opportunity to contact the arrow rest.

2. Description of Related Art

In an archery bow, an archery arrow is usually suspended within a cutout in a bow riser and supported by an arrow rest. Many conventional apparatuses for mounting the arrow rest with respect to the archery bow allow the arrow rest to rotate or pivot, for example in a forward direction to avoid contact with the archery arrow after the archery arrow is released from the archery bow. Upon release of the archery arrow, the arrow rest may return to the original arrow loading position by applying a return bias force, for example a spring bias. The return bias force may be applied in a horizontal or vertical direction and may be adjusted to control a rate of return of the arrow rest to the original arrow loading position.

However, when an archery arrow is released from an archery bow having a conventional "fall away" arrow rest, the arrow rest may return to the original position before the archery arrow passes the arrow rest due to an improperly adjusted return bias force, for example. Additionally, a fletching may contact a portion of the arrow rest during release of the archery arrow, which results in undesired deflection and/or misdirection of the archery arrow. Such deflection will cause an inaccurate shot, wherein the intended target is missed. Deflections may also cause undesired noise and archery arrow damage requiring premature replacement of archery arrow components.

Thus, there is an apparent need for an apparatus for mounting an arrow rest with respect to an archery bow which prevents a deflection and/or misdirection of an archery arrow after release of the archery arrow from the archery bow.

SUMMARY OF THE INVENTION

It is an object of this invention to provide an arrow rest to support an archery arrow which, upon release of the archery arrow, rotates or moves away from the archery arrow without interfering with or contacting a fletching or another component of the archery arrow.

It is another object of this invention to provide an arrow rest which, upon release of the archery arrow, is actuated to move away from the archery arrow, for example to prevent undesired deflection and/or misdirection of the released archery arrow.

It is another object of this invention to provide an arrow rest having an adjusting mechanism for varying or setting a force required to actuate the arrow rest to rotate from a first or arrow loading position to a second or actuated position.

It is yet another object of this invention to provide an arrow rest having a mechanism for adjusting a deflection or cushion distance which the arrow rest must travel before the arrow rest rotates or moves from the arrow loading position to the actuated position.

The above and other objects of this invention are accomplished with an apparatus for mounting an arrow rest with respect to an archery bow window which includes a housing, for example a bearing housing, mounted with respect to the archery bow window. The bearing housing may be rotatably positioned within a mounting bore formed by a support bracket. In one embodiment of this invention, the bearing housing is integrated with the support bracket. With the support bracket secured to the archery bow, a windage and an elevation of the arrow rest with respect to the support bracket can be adjusted by rotating the bearing housing within the mounting bore.

In one preferred embodiment of this invention, an arrow shaft support member is mounted with respect to the archery bow window. The arrow shaft support member moves in response to a movement of an archery arrow shaft. In one preferred embodiment of this invention, the arrow shaft support member may include a shaft rotatably positioned within a bore formed by the bearing housing and extending along the longitudinal axis of the apparatus. The shaft is rotatable between a first or arrow loading position and a second or actuated position. The arrow rest includes two prongs which support an archery arrow shaft in the arrow loading position. Preferably, each prong is connected to the shaft and rotatable with the shaft.

In one preferred embodiment of this invention, a cam is operatively connected to and operatively moveable or rotatable with the shaft. The cam forms a first cam surface having a variable profile along a length of the first cam surface. At least one boundary or transition surface is positioned or formed between the first cam surface and a periphery of the shaft and provides a transition or interference between the first cam surface and the periphery of shaft.

A first bias element, for example a compression spring, urges the follower toward the cam. A spring force adjustment means, for example an adjustment screw, is engageable with an aperture formed by the support bracket and contacts the first bias element. The adjustment screw may be rotated to urge the follower toward the first cam surface to adjust a bias force applied to the first cam surface by the follower. The bias force corresponds to a deflection or cushion force, which is a force required to deflect the prongs and disengage the follower from the first cam surface.

A second bias element, for example a torsion spring, is operatively connected to the shaft. The second bias element urges the shaft from the first position to the second position. A torsion spring force which is applied by the torsion spring to the shaft can be adjusted to affect the rate of rotation and acceleration of the shaft from the first position to the second position.

The archery bow can be set up to provide a slight downward component to a movement of the archery arrow after release of the archery arrow from the archery bow. The downward movement of the archery arrow urges the prongs forward in a downward rotational direction. As a result, the shaft is actuated to rotate from the first or arrow loading position to the second or actuated position. As the shaft rotates, the cam moves relative to the follower. As the follower contacts the transition surface, the second bias element provides a rotational torque to the shaft and the shaft rotates from the first position to the second position.

In one preferred embodiment of this invention, the shaft extends into a cavity formed by the bearing housing. The shaft forms a first interference surface and a second interference surface. A cam is operatively connected to the shaft. In one embodiment of this invention, the cam is rigidly connected to the shaft and rotates with the shaft. Alternatively, the cam may be pivotally connected to the shaft and may rotate relative to the shaft. Preferably, but not necessarily, the cam is pivotally connected to the shaft by a toggle bracket which is movable between a first toggle position and a second toggle position.

A follower contacts at least a portion of an exterior surface of the cam. A first bias element urges the follower toward the cam. A cushion force adjustment means, for example a first adjustment screw, moves or compresses the first bias element toward the follower to urge the follower toward the cam. Thus, a bias force applied to the cam by the follower is adjustable. The bias force initially maintains the shaft in the first position, wherein the prongs are positioned to accept and support an archery arrow. The bias force corresponds to a deflection or cushion force required to deflect the prongs. The toggle bracket correspondingly moves from the first toggle position to the second toggle position. A cushion distance adjustment means, for example a second adjustment screw, allows lateral adjustment of the follower with respect to the cam. Thus, an angle at which the follower applies the bias force to the cam, as well as a deflection or cushion distance of the follower, can be adjusted by rotating the second adjustment screw. The deflection or cushion distance defines a rotational distance, usually measured in degrees, which the arrow rest travels before it is actuated to move from the first position to the second position. This rotational distance corresponds to a distance which the cam must travel to move the toggle bracket from the first toggle position to the second toggle position.

The archery bow can be set up to provide a slight downward force component to the archery arrow after release of the archery arrow from the archery bow. The downward movement of the archery arrow urges the prongs forward in a downward rotational direction. As a result, the shaft moves from the first or arrow loading position to the second or actuated position. As the cam moves relative to the follower, a force vector of the first bias element causes the cam to accelerate toward the second toggle position.

Alternatively, if the archery arrow does not have a downward component to its movement, the arrow rest may be actuated to move from the first position to the second position by an inertial mass. The inertial mass remains stationary during the release of the archery arrow. As the arrow rest moves toward the stationary inertial mass during recoil of the archery bow, the cam is forced to move relative to the follower. Once the force vector of the follower relative to the cam moves from a counterclockwise direction to a clockwise direction, the arrow rest moves as described above.

In one preferred embodiment of this invention, the shaft is rotatably mounted within the bearing housing and at least a portion of the shaft extends into a cavity formed by the bearing housing. The shaft forms a first interference surface and a second interference surface, each extending radially from a longitudinal axis of the shaft.

A stirrup is mounted or connected to an end portion of the shaft which extends into the cavity. In one embodiment of this invention, the stirrup is rigidly connected to the shaft so that the stirrup rotates as the shaft rotates. Alternatively, the stirrup may be pivotally connected to the shaft to pivot independently of the shaft.

A bias element, for example an extension spring, is connected at a first end portion to the stirrup and at a second end portion to an adjustment block which is slidingly positioned within the bearing housing and moveable in at least one direction, for example in a generally vertical direction perpendicular to the longitudinal axis. With the shaft in the first position, the stirrup is moveable between a first toggle position wherein the stirrup contacts the first interference surface and a second toggle position wherein the stirrup contacts the second interference surface.

A cushion force adjustment means, for example a first adjustment screw, adjusts a distance between the adjustment block and the stirrup to apply a load force to the stirrup and initially maintain the shaft in the first position. The load force corresponds to a deflection or cushion force required to deflect the prongs and actuate the arrow rest.

A cushion distance adjustment means, for example a second adjustment screw, allows lateral adjustment of the second end portion of the bias element with respect to the first end portion of the bias element. An angle at which the bias element applies the load force to the stirrup, as well as a deflection or cushion distance of the bias element, can be adjusted by rotation of the second adjustment screw. The deflection or cushion distance relates to a distance which the stirrup must travel to move from the first toggle position to the second toggle position.

With the archery bow providing a slight downward component to a movement of the archery arrow after release of the archery arrow from the archery bow, the archery arrow urges the prongs forward in a downward direction. As a result, the stirrup moves from the first toggle position to the second toggle position, whereby the shaft rotates from the first position to the second position. As the stirrup moves relative to the second end portion of the bias element, a force vector of the bias element causes the stirrup to accelerate in a rotational direction. With the stirrup in the second toggle position, the shaft rotates until the shaft contacts a projection or stop pin formed into or connected to an inner surface of the bearing housing.

Alternatively, the arrow rest may be actuated to move from the first position to the second position by an inertial mass. If the archery arrow does not have a downward component to its movement, the inertial mass will remain stationary during the release of the archery arrow. During recoil of the archery bow toward the archer's palm, the stirrup moves relative to the inertial mass. Because the arrow rest moves toward the stationary inertial mass, the stirrup is forced to move relative to the second end portion of the bias element. Once the force vector of the second end portion of the bias element relative to the stirrup moves from a counterclockwise direction to a clockwise direction, the arrow rest moves as described above.

BRIEF DESCRIPTION OF THE DRAWINGS

The drawings show different features of an apparatus for mounting an arrow rest with respect to an archery bow window according to preferred embodiments of this invention, wherein.

DETAILED DESCRIPTION OF PREFERRED EMBODIMENTS

Figure 1:
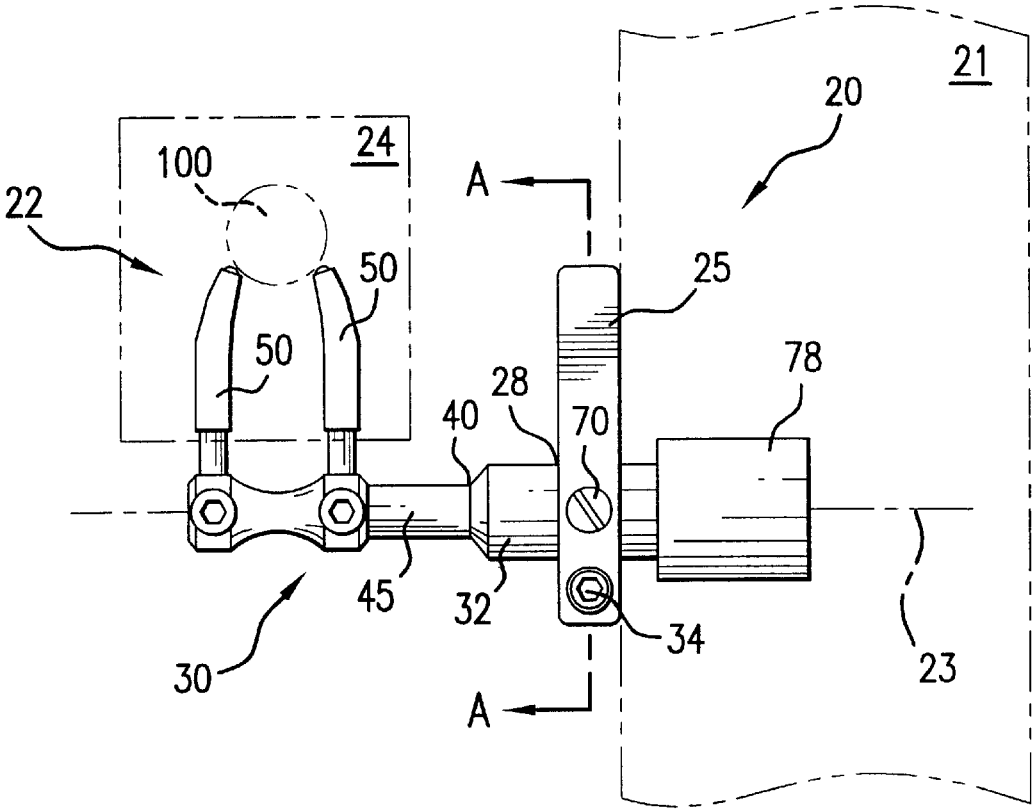
FIG. 1 is a front view of an apparatus for mounting an arrow rest with respect to an archery bow window, according to one preferred embodiment of this invention.
Figure 2:
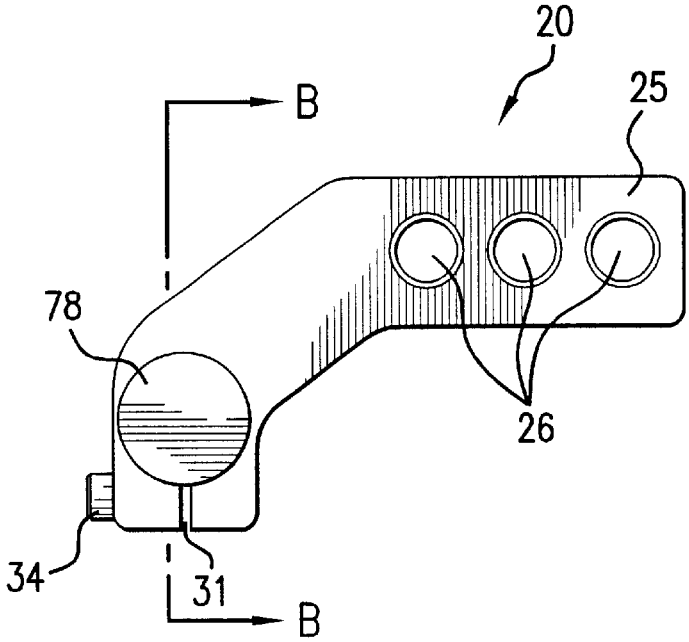
FIG. 2 is a side view of an apparatus for mounting an arrow rest with respect to an archery bow window, according to one preferred embodiment of this invention.

In one preferred embodiment of this invention as shown in FIGS. 1–4, an apparatus 20 for mounting an arrow rest 22 with respect to an archery bow 21 having an archery bow window 24 comprises a support bracket 25. Arrow rest 22 can accept and support an archery arrow shaft 100 and rotates or moves in response to a movement of archery arrow shaft 100. Support bracket 25 can have a general L-shape or any other suitable shape. As shown in FIG. 2, support bracket 25 forms a plurality of apertures 26 for mounting support bracket 25 with respect to or against archery bow 21. Preferably, but not necessarily, at least one of apertures 26 is threaded for mating engagement with a threaded fastener, such as a screw or bolt, that can be used to secure arrow rest 22 to archery bow 21. Support bracket 25 further forms a mounting bore 28.

A housing, for example a bearing housing 32, is fixed with respect to archery bow 21 and/or archery bow window 24. For example, bearing housing 32 may be connected directly or indirectly to support bracket 25. Preferably, bearing housing 32 is positioned within mounting bore 28. Alternatively, bearing housing 32 may be integrated with support bracket 25. In one preferred embodiment of this invention, support bracket 25 forms a slit or opening 31, as shown in FIG. 2. In one preferred embodiment of this invention, a fastener 34, for example a screw or bolt, is threadedly engageable with a threaded bore formed in support bracket 25 transverse to mounting bore 28. Bearing housing 32 is secured within mounting bore 28 by rotation of fastener 34, whereby opening 31 narrows and at least a portion of a surface forming mounting bore 28 contacts bearing housing 32. With support bracket 25 secured to archery bow 21, a windage and/or an elevation position of arrow rest 22 with respect to support bracket 25 is adjustable by sliding and/or rotating bearing housing 32 relative to support bracket 25. The term "windage" refers to a horizontal or lateral position of arrow rest 22, left-to-right as shown in FIG. 1, with respect to support bracket 25. The term "elevation" refers to a vertical position of an anterior end portion of arrow rest 22 with respect to a distal end portion of arrow rest 22.

In one preferred embodiment of this invention, an arrow shaft support member 30 is mounted with respect to bearing housing 32 and moveable between a first or arrow loading position and a second or actuated position. The second or actuated position may be a fixed position or a free position wherein arrow rest 22 will not support archery arrow shaft 100. In one preferred embodiment of this invention, bearing housing 32 forms a bore 40 along a longitudinal axis of bearing housing 32 which is preferably coaxially aligned with a longitudinal axis 23 of apparatus 20. Preferably, but not necessarily, bore 40 is cylindrical and has a generally circular cross-section. Bore 40 may have any suitable cross-sectional shape and/or cross-sectional area.

Figure 4:
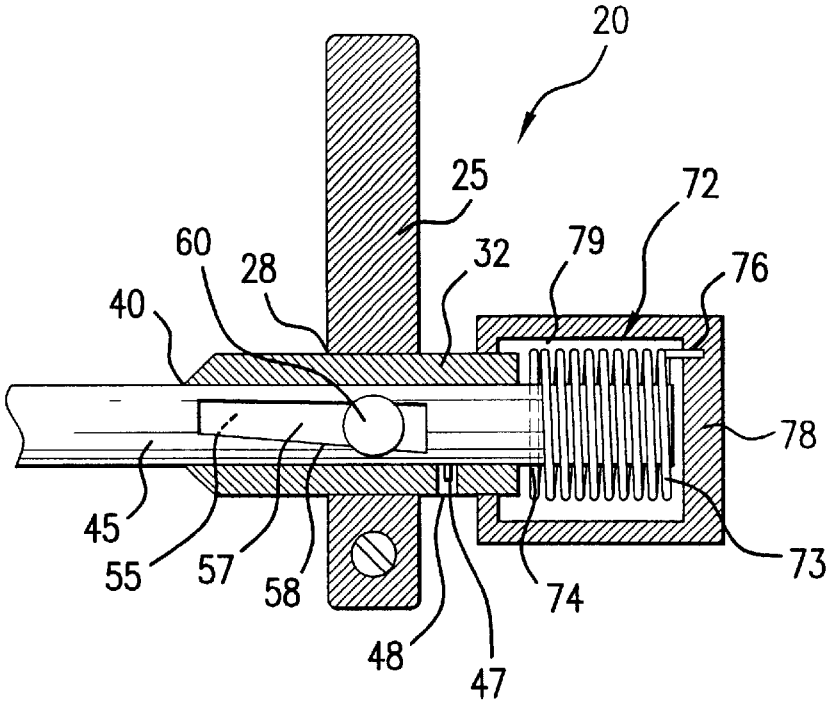
FIG. 4 is a partial sectional view, of an apparatus for mounting an arrow rest with respect to an archery bow window, taken along line B—B as shown in FIG. 2, according to one preferred embodiment of this invention.

A shaft 45 is mounted with respect to bearing housing 32, for example positioned within bore 40 and extending along longitudinal axis 23. Preferably, shaft 45 is rotatably mounted within bore 40 and rotatable between a first or arrow loading position and a second or actuated position. In one preferred embodiment of this invention, shaft 45 comprises a stop pin 47 which limits the rotational movement of shaft 45 within bore 40, as shown in FIG. 4. For example, shaft 45 rotates within bore 40 a distance until stop pin 47 contacts a stopping surface 48 of bearing housing 32.

Stopping surface 48 may be formed into or integrated with an interior surface of bearing housing 32 forming bore 40. Alternatively, stopping surface 48 may comprise at least one projection or pin which extends radially inward from the interior surface of bearing housing 32 to contact stop pin 47 and prevent further rotation of shaft 45 within bore 40. Preferably, two projections or pins extend radially inward from the interior surface of bearing housing 32 to limit the rotation of shaft 45 between the first position and the second position.

As shown in FIG. 1, for example, arrow rest 22 further comprises at least one prong 50 attached or connected to a first end portion of shaft 45. Preferably, two prongs 50 are each connected to shaft 45 using fastening means well known to those having ordinary skill in the art, for example a screw or a bolt. Alternatively, prongs 50 may be formed into or integrated with shaft 45. Prongs 50 preferably rotate with or as a function of shaft 45.

In one preferred embodiment of this invention, a cam 55 is operatively coupled with arrow shaft support member 30 and operatively moveable with respect to archery bow window 21. In one preferred embodiment of this invention, cam 55 is operatively connected to and operatively rotatable with shaft 45. Cam 55 may be operatively connected and operatively rotatable with shaft 45 as a result of being integrated with or connected to shaft 45 through gears, linkages, or other mechanical connections known to those having ordinary skill in the art. Preferably, but not necessarily, cam 55 is formed by or integrated with shaft 45, as shown in FIGS. 3–6. Referring to FIGS. 3–6, cam 55 comprises a first cam surface 57. First cam surface 57 may comprise any suitably shaped surface. For example, at least a portion of first cam surface 57 may have a convex, concave and/or flat surface. Preferably, but not necessarily, at least a portion of first cam surface 57 has a slightly depressed surface, depressed radially inward relative to a periphery of a portion of cam 55 that has a maximum radius.

Figure 5:
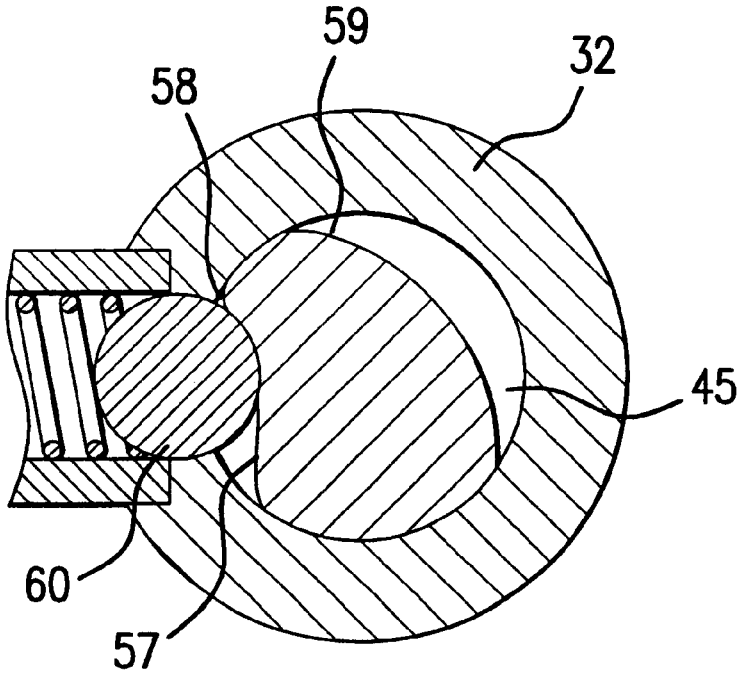
FIG. 5 is a cross-sectional view of a follower positioned to contact a first cam surface having a variable cam surface profile, according to one preferred embodiment of this invention.
Figure 6:
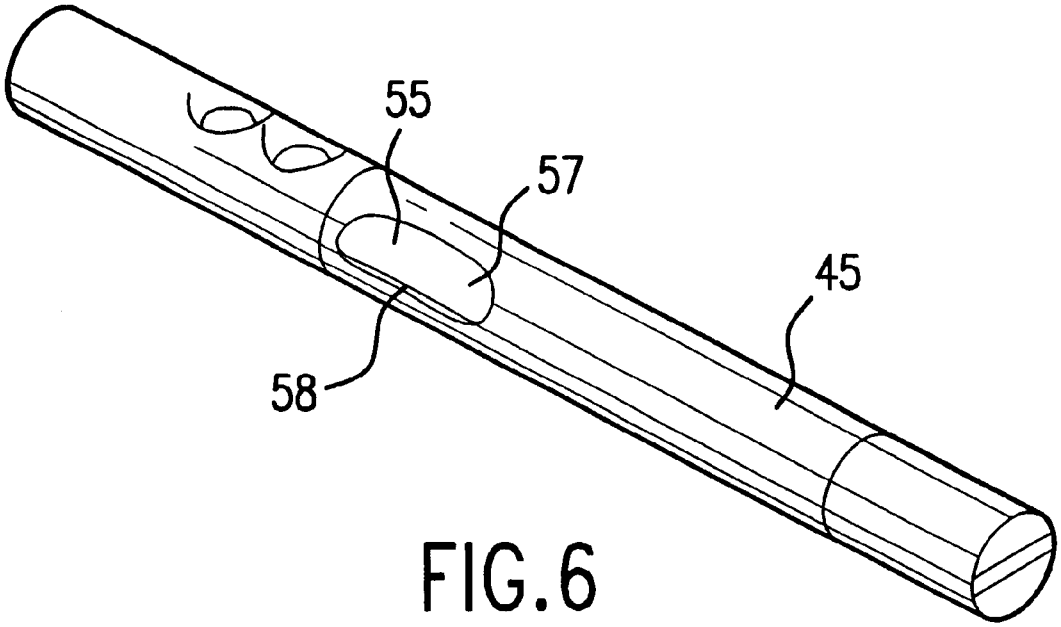
FIG. 6 is a perspective view of a shaft and a cam having a first cam surface with a variable cam surface profile, according to one preferred embodiment of this invention.

In one preferred embodiment of this invention, first cam surface 57 can have a cam surface width, measured along a peripheral section of first cam surface 57, which may vary along a length of first cam surface 57, as shown in FIG. 4. In another preferred embodiment of this invention, first cam surface 57 may have a cam surface profile, as shown in FIGS. 5 and 6, which varies along the length of first cam surface 57. Shaft 45 may be moved laterally relative to support bracket 25, left-to-right as shown in FIG. 4, to adjustably position cam 55 to position or expose a particular portion of a cam variable surface profile which corresponds to a desired force profile acting on a follower 60 which is required to actuate arrow rest 22. As shown in FIG. 6, as shaft 45 is moved laterally relative to support bracket 25, the cam surface profile may vary.

In one preferred embodiment of this invention, at least one transition surface 58 is preferably formed by first cam surface 57 and/or positioned between first cam surface 57 and a periphery of shaft 45 to provide a boundary or interference between first cam surface 57 and the periphery of shaft 45. Alternatively, in another preferred embodiment as shown in FIG. 5, cam 55 need not coincide with shaft 45. For example, transition surface 58 may be positioned between first cam surface 57 and a second cam surface 59, which corresponds to the second or actuated position, to provide a boundary or interference between first cam surface 57 and second cam surface 59. Second cam surface 59, as well as first cam surface 57, does not necessarily coincide with the periphery of shaft 45. However, at least a portion of cam 55 may contact an inner surface of bearing housing 32 forming bore 40.

It is apparent to those skilled in the art that first cam surface 57 may have any suitable or desired cam surface profile which would correspond to a desired or predetermined force or force profile applied to prongs 50 to actuate arrow rest 22. For example, as shown in FIG. 6, shaft 45 can be moved relative to support bracket 25 to a position wherein the force applied to prongs 50 must be sufficient to overcome the boundary or interference between first cam surface 57 and the periphery of shaft 45, or between first cam surface 57 and second cam surface 59 in another embodiment, and to actuate arrow rest 22.

Figure 3:
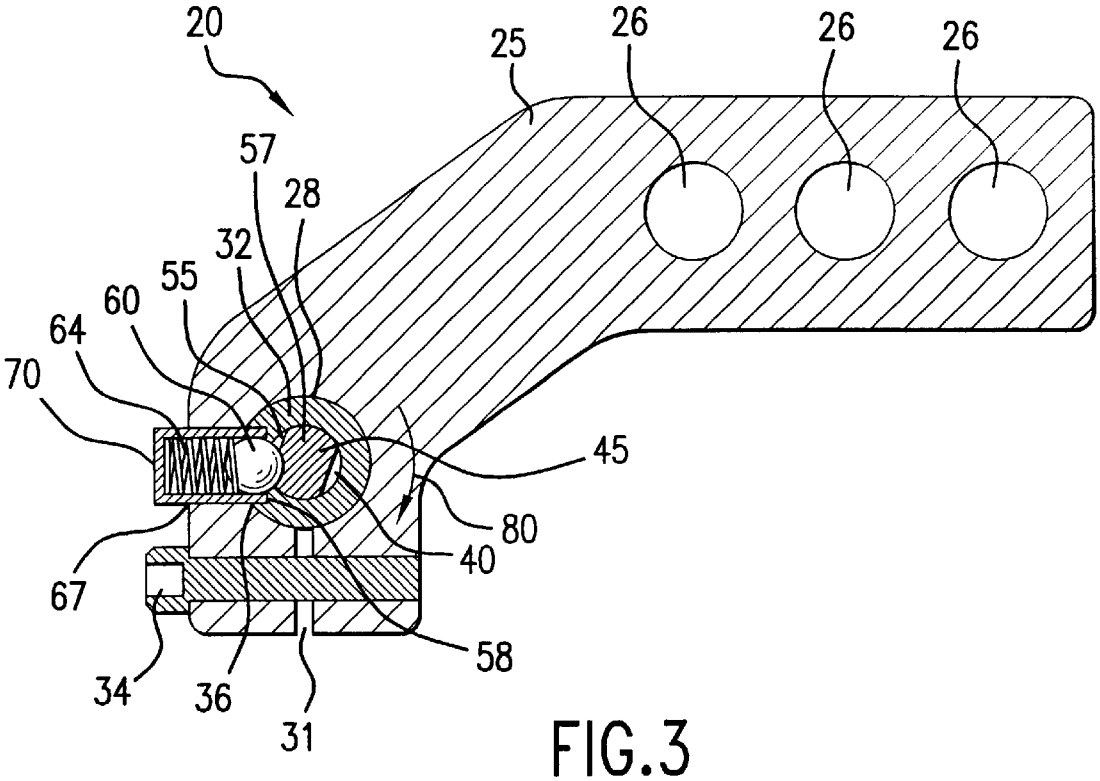
FIG. 3 is a partial sectional view, of an apparatus for mounting an arrow rest with respect to an archery bow window, taken along line A—A as shown in FIG. 1, according to one preferred embodiment of this invention.

In one preferred embodiment of this invention, follower 60 contacts at least a portion of first cam surface 57. Preferably, but not necessarily, follower 60 is positioned within an opening 36, for example an aperture, formed by bearing housing 32 as shown in FIG. 3 or by any other suitable structure. Follower 60 may comprise a ball bearing, a plunger, a wheel, a roller or any other suitable follower or following device known to those having ordinary skill in the art. In one preferred embodiment of this invention, as shown in FIGS. 3 and 4, follower 60 comprises a ball bearing having a generally spherical exterior surface, a portion of which contacts first cam surface 57 when shaft 45 is in the first position. It is apparent that follower 60 can also have any suitably shaped non-spherical exterior surface.

As shown in FIG. 3, in one preferred embodiment of this invention, follower 60 may be at least partially positioned within aperture or opening 36 formed through bearing housing 32. A first bias element 64, for example a compression spring, a leaf spring or any other suitable bias element known to those having ordinary skill in the art, can be positioned within an aperture 67 of support bracket 25 and aligned with opening 36 to urge follower 60 toward or against cam 55. A spring force adjustment means or an adjusting element, for example an adjustment screw 70 is threadedly engageable with a surface of support bracket 25 forming aperture 67 and contacts first bias element 64. Rotation of adjustment screw 70, depending on the relative direction, will elongate or shorten first bias element 64. Thus, in one preferred embodiment of this invention, adjustment screw 70 can change the length of first bias element 64 and thus vary a bias force of first bias element 64 applied to follower 60 to urge follower 60 toward or against first cam surface 57. Thus, the bias force applied to first cam surface 57 by follower 60 is adjustable. This bias force initially maintains shaft 45 in the first or arrow loading position, wherein prongs 50 are positioned to accept and support an archery arrow. This bias force is related to a deflection or cushion force. The deflection force or cushion force corresponds to a force required to deflect prongs 50, for example to overcome the bias force of first bias element 64 and thus rotate prongs 50 in a downward direction or move prongs 50 in a generally vertical downward direction, to a point or region where follower 60 no longer contacts first cam surface 57.

In one preferred embodiment of this invention, a second bias element 72, for example a torsion spring 73 or any other suitable bias element known to those having ordinary skill in the art, is operatively connected to shaft 45, as shown in FIG. 4. Second bias element 72 urges shaft 45 from the first position to the second position. Preferably for space conservation, but not necessarily, torsion spring 73 is positioned about at least a portion of a periphery of shaft 45. A first end portion 74 of torsion spring 73 is secured with respect to shaft 45 by means known to those having ordinary skill in the art. For example, first end portion 74 may be inserted into an aperture formed by shaft 45 or otherwise connected to shaft 45, to secure torsion spring 73 with respect to shaft 45. A cap 78 is rotatably mounted to bearing housing 32 and forms a cavity 79 to enclose torsion spring 73, as shown in the embodiment of FIG. 4. A second end portion 76 of torsion spring 73 is secured with respect to cap 78. Preferably, but not necessarily, second end portion 76 is inserted into an aperture formed by an interior surface of cap 78 for securing torsion spring 73 to cap 78, as shown in FIG. 4. Other means known to those skilled in the art may be used to secure torsion spring 73 with respect to shaft 45 and/or cap 78.

Cap 78 provides a means for adjusting a torsion spring force which is applied to shaft 45. Rotation of cap 78 with respect to shaft 45 adjusts the torsion spring force applied by torsion spring 73 to shaft 45, which force affects the rate of rotation and acceleration of shaft 45 from the first position to the second position. After cap 78 is rotated to change the length of torsion spring 73 and thus provide a desired torsion spring force to shaft 45, a screw or other conventional mechanical fastener connected to cap 78 may be used to secure cap 78 with respect to bearing housing 32 and with respect to shaft 45.

Referring to FIGS. 1–6, in one preferred embodiment of this invention, arrow rest 22 and prongs 50 are initially positioned in the first or arrow loading position to accept and support archery arrow shaft 100. Arrow rest 22 may be manually adjustable for an elevation position and/or a centershot position. Screw 34 is rotated to allow manual adjustment of arrow rest 22 to a desired position by rotating arrow rest 22 with respect to bearing housing 32. Archery bow 21 may be set up or adjusted to provide a slight downward component to a movement of archery arrow shaft 100 after release of the archery arrow from archery bow 21.

Arrow rest 22 moves in response to a movement of archery arrow shaft 100. For example, upon release of the archery arrow from archery bow 21, archery arrow shaft 100 urges prongs 50 forward, i.e. in a downward rotational direction, as shown by arrow 80 in FIG. 3. As shaft 45 rotates, cam 55 moves relative to follower 60 to transition surface 58. As shaft 45 rotates and follower 60 meets transition surface 58, the force applied by archery arrow shaft 100 is preferably greater than the resisting bias force of first bias element 64 and first bias element 64 can no longer retain shaft 45 in the first position. Follower 60 transitions across the boundary or transition surface 58 between the first position and the second position as second bias element 72 provides a rotational torque to shaft 45 to urge shaft 45 from the first position to the second position. Shaft 45 rotates until stop pin 47 contacts stopping surface 48 of bearing housing 32, corresponding to the second position.

In one preferred embodiment of this invention, in order to return shaft 45, as well as prongs 50, to the first or arrow loading position from the actuated position, prongs 50 are manually rotated in an opposite direction, for example an upward rotational direction, until follower 60 contacts first cam surface 57 and first bias element 64 urges follower 60 toward first cam surface 57 to retain shaft 45 in the first position. The bias force applied through follower 60 on first cam surface 57 is sufficient to resist the rotational torque applied by second bias element 72 on shaft 45.

Figure 8:
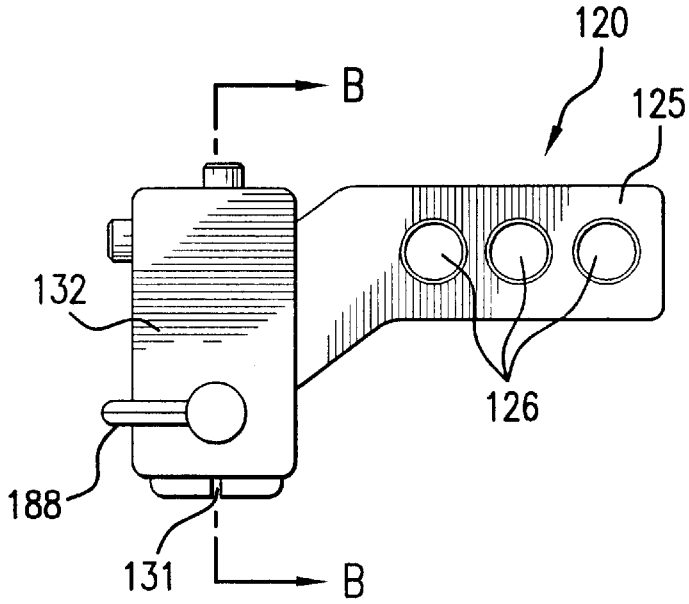
FIG. 8 is a side view of an apparatus for mounting an arrow rest with respect to an archery bow window, according to one preferred embodiment of this invention.

In another preferred embodiment of this invention as shown in FIGS. 714, an apparatus 120 for mounting an arrow rest 122 with respect to an archery bow 121 having an archery bow window 124 comprises a support bracket 125. Support bracket 125 can have a general L-shape or any other suitable shape. As shown in FIG. 8, support bracket 125 forms a plurality of apertures 126 for mounting support bracket 125 with respect to archery bow 121. Preferably, but not necessarily, at least one of apertures 126 is threaded for mating engagement with a threaded fastener, such as a screw or bolt, that can be used to secure arrow rest 122 to archery bow 121. Support bracket 125 further forms a mounting bore 128.

A housing, for example bearing housing 132, is fixed with respect to archery bow 121 and/or archery bow window 124. For example, bearing housing 132 may be connected directly or indirectly to support bracket 125. In one preferred embodiment of this invention, bearing housing 132 is integrated with support bracket 125. Alternatively, bearing housing 132 is positioned within mounting bore 128. Preferably, but not necessarily, support bracket 125 forms a slit or opening 131, as shown in FIG. 8. In one preferred embodiment of this invention, a fastener 134, for example a screw or bolt, is threadedly engageable with a threaded bore formed in support bracket 125 transverse to mounting bore 128. Bearing housing 132 is secured within mounting bore 128 by rotation of fastener 134, whereby opening 131 narrows and at least a portion of a surface forming mounting bore 128 contacts bearing housing 132. With support bracket 125 secured to archery bow 121, a windage and/or an elevation position of arrow rest 122 with respect to support bracket 125 is adjustable by sliding and/or rotating bearing housing 132 relative to support bracket 125.

In one preferred embodiment of this invention, an arrow shaft support member 130 is mounted with respect to bearing housing 132 and moveable between a first or arrow loading position and a second or actuated position. In one preferred embodiment of this invention, bearing housing 132 forms a bore 140 along a longitudinal axis of bearing housing 132 which is preferably coaxially aligned with a longitudinal axis 123 of apparatus 120. Preferably, but not necessarily, bore 140 is cylindrical and has a generally circular cross-section. Bore 140 may have any suitable cross-sectional shape and/or cross-sectional area.

Figure 9:
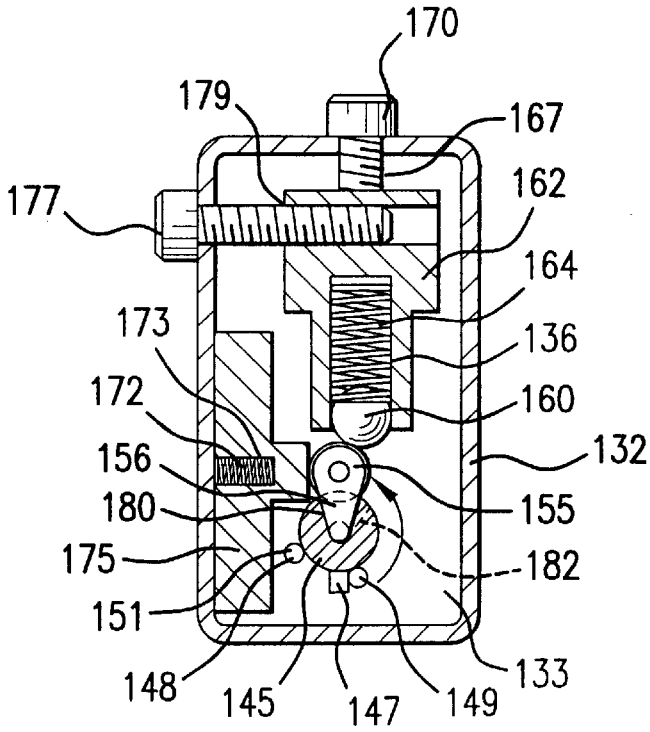
FIG. 9 is a partial sectional view, of an apparatus for mounting an arrow rest with respect to an archery bow window, taken along line A—A as shown in FIG. 7, according to one preferred embodiment of this invention.
Figure 10:
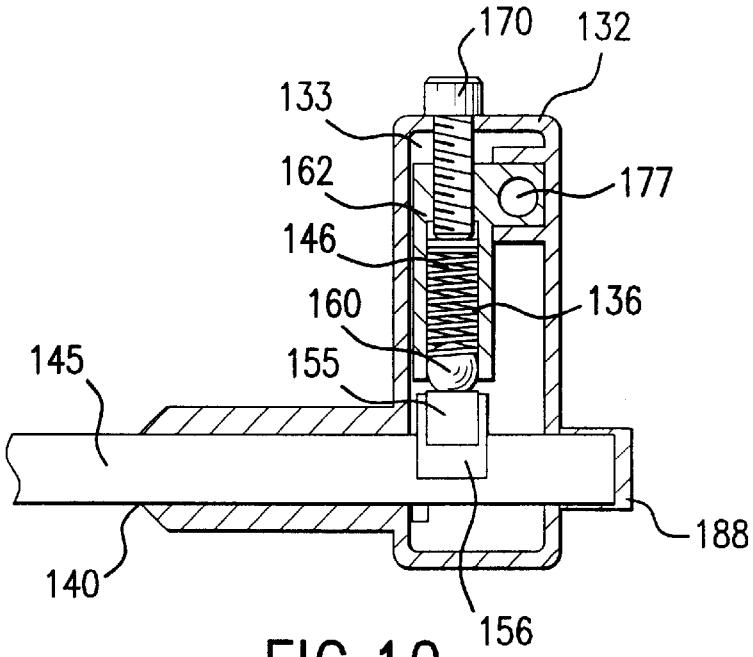
FIG. 10 is a partial sectional view, of an apparatus for mounting an arrow rest with respect to an archery bow window, taken along line B—B as shown in FIG. 8, according to one preferred embodiment of this invention.

A shaft 145 is mounted with respect to bearing housing 132. For example, shaft 145 may be positioned within bore 140 and extend along longitudinal axis 123. Preferably, shaft 145 is rotatably mounted within bore 140 and rotatable between a first or arrow loading position and a second or actuated position. At least a portion of shaft 145 extends into a cavity 133 formed by bearing housing 132, as shown in FIGS. 9 and 10. Preferably, shaft 145 forms at least one interference surface. More preferably, shaft 145 forms a first interference surface 180 and a second interference surface 182.

In one embodiment of this invention as shown in FIG. 9, shaft 145 comprises a projection or pin 147, attached to or integrated with shaft 145, which limits the rotational movement of shaft 145 within bore 140. For example, shaft 145 rotates within bore 140 a radial distance until stop pin 147 contacts at least one stopping surface 148 within bearing housing 132. Stopping surface 148 may be formed into or integrated with an interior surface of bearing housing 132 forming bore 140. Alternatively, stopping surface 148 may comprise at least one projection or pin which extends inward from the interior surface of bearing housing 132 to contact stop pin 147 and prevent further rotation of shaft 145 within bore 140. Preferably, as shown in FIG. 9, two pins 149, 151 extend inward from the interior surface of bearing housing 132 to limit the rotation of shaft 145 between the first position and the second position.

Figure 7:
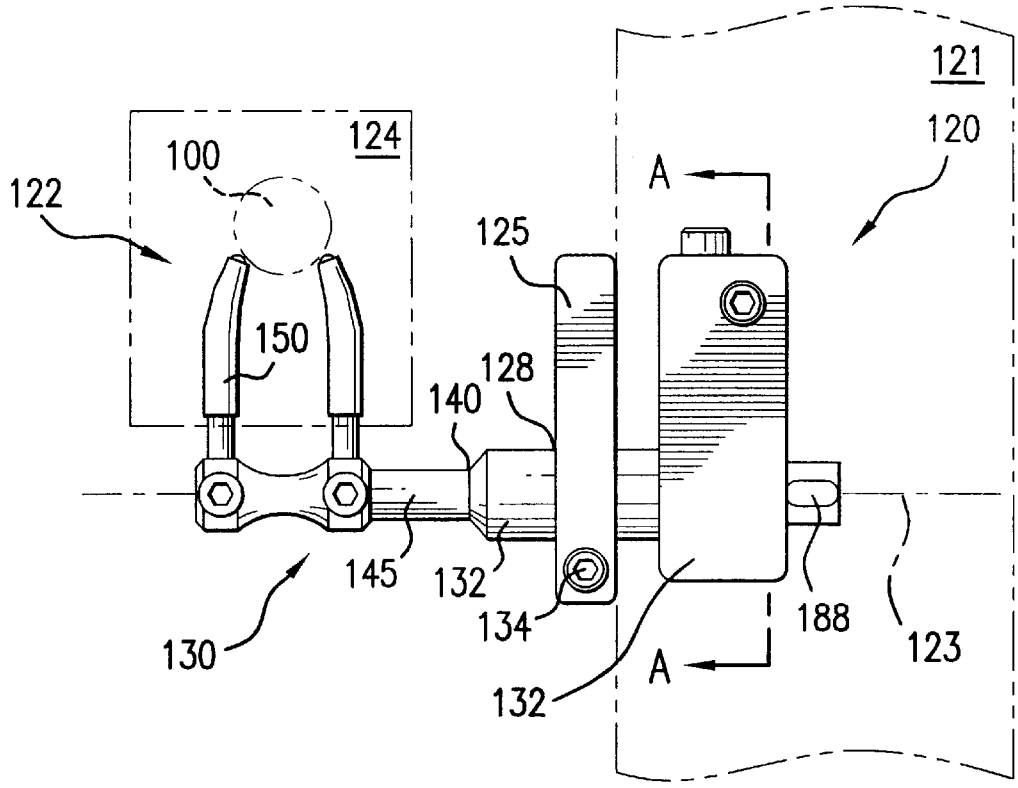
FIG. 7 is a front view of an apparatus for mounting an arrow rest with respect to an archery bow window, according to one preferred embodiment of this invention.

As shown in FIG. 7, for example, arrow rest 122 further comprises at least one prong 150 attached or connected to a first end portion of shaft 145. Preferably, two prongs 150 are each connected to shaft 145 using fastening means well known to those having ordinary skill in the art, for example a screw or a bolt. Alternatively, prongs 150 may be formed or integrated with shaft 145. Prongs 150 preferably rotate with or as a function of shaft 145.

In one preferred embodiment of this invention, a cam 155 is operatively coupled with arrow shaft support member 130 and operatively moveable with respect to archery bow window 124. In one preferred embodiment of this invention, cam 155 is operatively connected to and rotatable relative to shaft 145, as shown in FIGS. 9–14. Alternatively, cam 155 may be rigidly connected to and rotatable with shaft 145. Cam 155 rotates relative to longitudinal axis 123. In one preferred embodiment of this invention, as shown for example in FIGS. 9 and 10, cam 155 comprises a roller having a generally cylindrical shape and a generally flat exterior surface. Cam 155 may comprise any suitable shape and/or exterior surface.

Preferably, but not necessarily, a toggle bracket 156 connects cam 155 with shaft 145. Other suitable means known to those skilled in the art can be used to operatively connect cam 155 with shaft 145. As shown in FIG. 9, toggle bracket 156 at a first end portion is pivotally connected to shaft 145 about longitudinal axis 123 and at a second end portion is connected to cam 155. Cam 155 is connected to toggle bracket 156 to allow rotation of cam 155 about a central axis of cam 155. Toggle bracket 156 is pivotally movable with respect to shaft 145 between a first toggle position wherein at least a portion of toggle bracket 156 contacts first interference surface 180 and a second toggle position wherein at least a portion of toggle bracket 156 contacts second interference surface 182.

A follower 160 contacts at least a portion of the exterior surface of cam 155. Follower 160 may comprise a ball bearing, a plunger, a wheel, a roller or any other suitable follower or following device known to those having ordinary skill in the art. In accordance with one preferred embodiment of this invention, as shown in FIGS. 9 and 10, follower 160 comprises a ball bearing having a generally spherical exterior surface, a portion of which contacts the exterior surface of cam 155. It Is apparent that follower 160 can have any suitably shaped non-spherical exterior surface.

In one preferred embodiment as shown in FIGS. 9 and 10, follower 160 is at least partially positioned within a bore 136 formed by an adjustment block 162. Adjustment block 162 is slidingly positioned within bearing housing 132 and moveable in at least one direction, for example in a generally vertical direction. A first bias element 164, for example a compression spring, a leaf spring or any other suitable bias element known to those having ordinary skill in the art, is positioned within bore 136 to urge follower 160 toward and/or against cam 155.

A cushion force adjustment means, for example a first adjustment screw 170 is threadedly engageable with a surface of adjustment block 162 forming a bore 167 which is aligned with bore 136. First adjustment screw 170 contacts first bias element 164, as shown in FIGS. 9 and 10. Rotation of first adjustment screw 170, depending on the relative direction, will elongate or shorten first bias element 164. Thus, in one preferred embodiment, first adjustment screw 170 can change the length of first bias element 164 and thus vary the bias force of first bias element 164 and the bias force applied to follower 160 to urge follower 160 toward and/or against cam 155. Thus, a position of first adjustment screw 170 relative to follower 160 is adjustable to control the bias force applied to cam 155 through follower 160. This bias force initially maintains shaft 145 in the first or arrow loading position, wherein prongs 150 are positioned to accept and support an archery arrow. This bias force is related to a deflection or cushion force. The deflection force or cushion force corresponds to a force required to deflect prongs 150 to overcome the bias force of first bias element 164 and thus rotate prongs 150 in a downward direction.

In one preferred embodiment of this invention, a second bias element 172, for example a compression spring or any other suitable bias element known to those skilled in the art, is operatively connected to an inertial mass 175. Preferably, but not necessarily, second bias element 172 is positioned within a bore 173 formed by inertial mass 175. As shown in FIG. 9, second bias element 172 urges inertial mass 175 toward cam 155 and first bias element 164 urges cam 155 toward inertial mass 175 to maintain contact between inertial mass 175 and cam 155 when toggle bracket 156 is in the first toggle position.

A cushion distance adjustment means, for example a second adjustment screw 177 is threadedly engageable with a surface of adjustment block 162 forming an aperture 179, as shown in FIG. 9. Rotation of second adjustment screw 177 allows lateral adjustment of follower 160 with respect to cam 155 by movement or displacement of adjustment block 162 in a generally horizontal direction, left-to-right as shown in FIG. 9. Thus, an angle at which follower 160 applies the bias force to cam 155, as well as a deflection or cushion distance of follower 160, can be adjusted by rotation of second adjustment screw 177. The deflection or cushion distance defines a rotational distance, typically measured in degrees, which prongs 150 travel before shaft 145 is actuated to move from the first position to the second position. A rotational motion of prongs 150 and shaft 145 corresponds to a rotational motion of cam 155 with respect to follower 160 required to move toggle bracket 156 from the first toggle position to the second toggle position.

Figure 11:
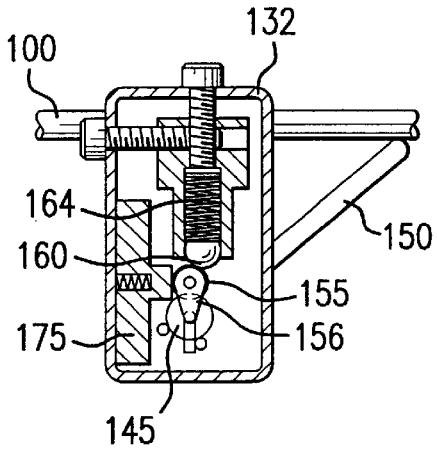
FIGS. 11–14 illustrate a rotational movement from a first position to a second position of a shaft and a prong of an apparatus corresponding to a rotational movement of a cam relative to a follower, according to one preferred embodiment of this invention.
Figure 12:
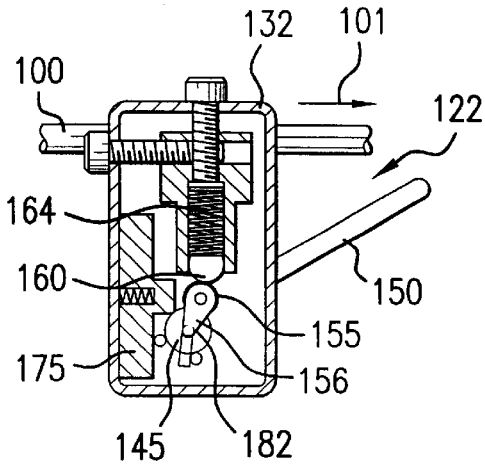
Figure 13:
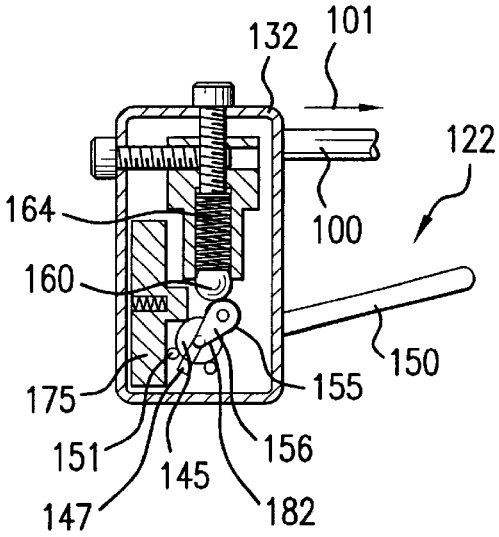
Figure 14:
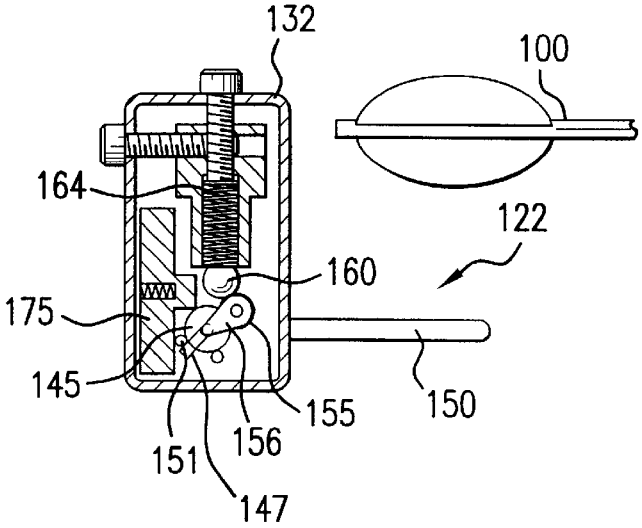
Figure 15:
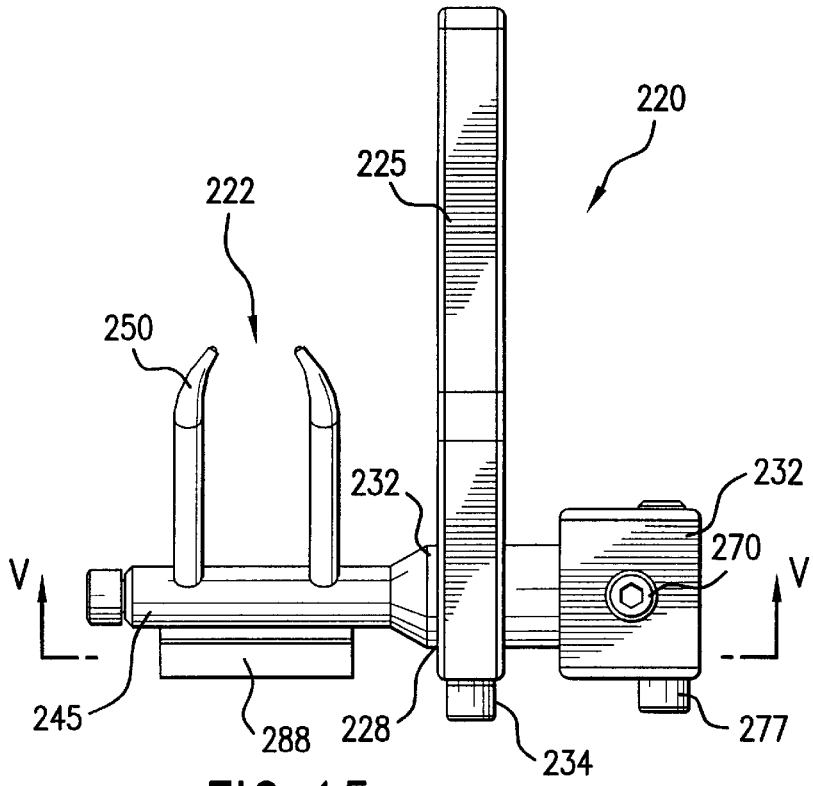
FIG. 15 is a top view of an apparatus for mounting an arrow rest with respect to an archery bow window, according to one preferred embodiment of this invention.
Figure 16:
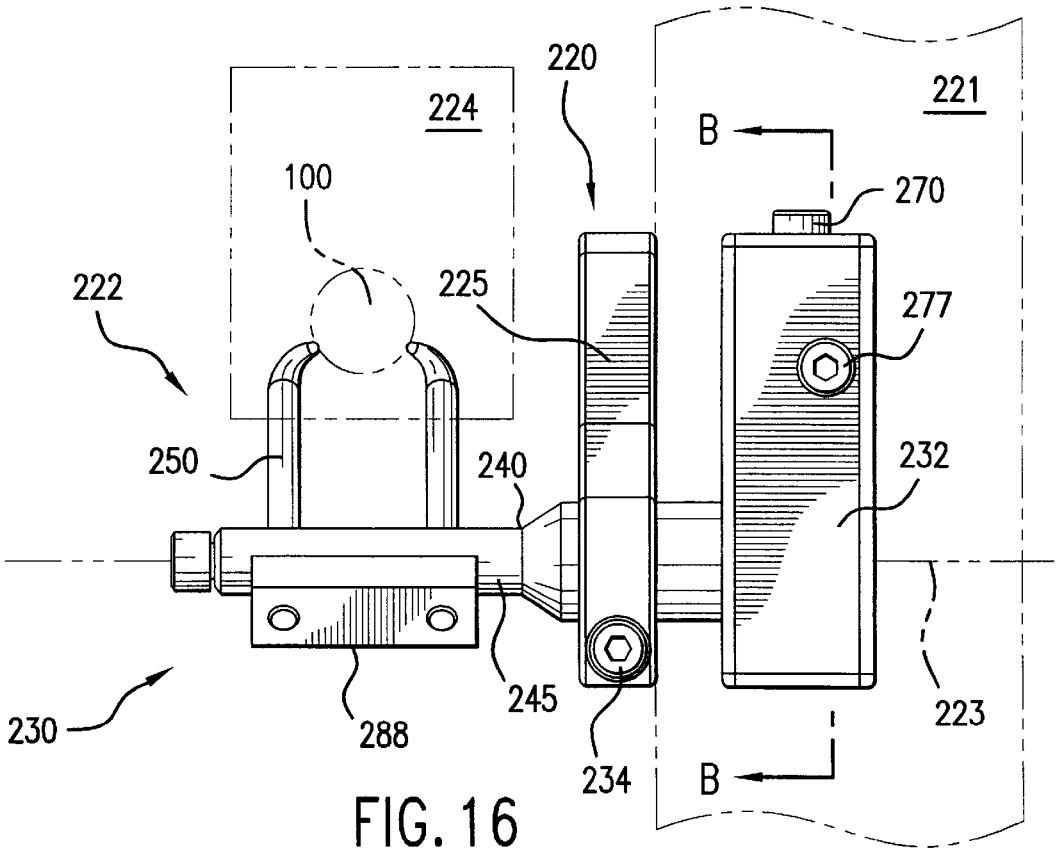
FIG. 16 is a front view of an apparatus for mounting an arrow rest with respect to an archery bow window, according to one preferred embodiment of this invention.

Referring to FIG. 11, in one preferred embodiment of this invention, arrow rest 122 and prongs 150 are initially positioned in the first or arrow loading position to accept and support an archery arrow. Arrow rest 122 can be adjusted for elevation and centershot, as discussed above. Archery bow 121 may be set up or adjusted to provide a slight downward component to a movement of archery arrow shaft 100 after release of the archery arrow from archery bow 121. Arrow rest 122 moves in response to the movement of archery arrow shaft 100. For example, upon release of the archery arrow from archery bow 121, archery arrow shaft 100 urges prongs 150 forward in a downward rotational direction, as shown in FIGS. 12–14. As cam 155 moves relative to follower 160, a force vector of first bias element 164 causes cam 155 and toggle bracket 156 to accelerate in a direction toward the second toggle position.

FIGS. 11–14 show a rotation of prongs 150 as a result of the release of an archery arrow having a slight downward directional component, in accordance with one preferred embodiment of this invention. Arrow 101, as shown in FIGS. 12 and 13, indicates the direction of movement of archery arrow shaft 100 with respect to arrow rest 122. FIG. 11 illustrates prongs 150 in a first or arrow loading position. FIG. 12 illustrates cam 155 rotated about 20° relative to follower 160. Prongs 150 correspondingly rotate about 6° relative to the first position, as shown in FIG. 11. As shown in FIG. 12, toggle bracket 156 is in the second toggle position, contacting second transition surface 182 and shaft 145 is in the first position. FIG. 13 illustrates cam 155 rotated about 40° relative to follower 160 and prongs 150 rotated about 26° relative to the first position. Shaft 145 rotates with cam 155 as a result of toggle bracket 156 contacting second transition surface 182. Shaft 145 rotates with cam 155 until pin 147 contacts second stop pin 151, corresponding to the second position. FIG. 14 illustrates shaft 145 in the second or actuated position, with cam 155 rotated about 60° relative to follower 160 and prongs 150 rotated about 46° relative to the first position.

The movement from the first toggle position to the second toggle position allows a mass of cam 155 to be relatively low so that the force vector changes rapidly. This improves the response of shaft 145 and prongs 150. In one embodiment of this invention wherein cam 155 is rigidly connected to shaft 145, cam 155 does not toggle. In this embodiment, the force vector initially changes slowly due to the small angle and small effective force as well as the comparatively large mass of shaft 145 and prongs 150.

Arrow rest 122 may also be actuated to move from the first position to the second position by inertial mass 175. If the archery arrow does not have a downward component to its movement, archery arrow shaft 100 will not force prongs 150 in a forward direction and, thus, shaft 145 and cam 155 will not rotate initially. Inertial mass 175 will remain stationary during the release of the archery arrow. Recoil of archery bow 121 toward the archer's palm results in relative movement between inertial mass 175 and cam 155. Because arrow rest 122 moves toward stationary inertial mass 175, cam 155 is forced to move relative to follower 160. Once the force vector of follower 160 relative to cam 155 moves from a counterclockwise direction to a clockwise direction, arrow rest 122 moves as described above and illustrated in FIGS. 12–14.

In order to return shaft 145, as well as prongs 150, to the first or arrow loading position from the actuated position, a cocking lever 188, operatively connected to shaft 145, is rotated until cam 155 contacts first interference surface 180.

In one embodiment of the invention, a torsion spring (not shown) is positioned about at least a portion of a periphery of shaft 145, as well known in the art. A first end portion of the torsion spring is secured to shaft 145 by conventional means. For example, the first end portion may be inserted into an aperture formed by shaft 145 to secure the torsion spring to shaft 145. Cocking lever 188 is rotatably mounted to shaft 145 and encloses the torsion spring. A second end portion of the torsion spring is secured to cocking lever 188. Preferably, but not necessarily, the second end portion is inserted into an aperture formed by an interior surface of cocking lever 188 for securing the torsion spring to cocking lever 188. Other means known to those skilled in the art may be used to secure the torsion spring to shaft 145 and/or cocking lever 188.

Cocking lever 188 provides a means for adjusting a torsion spring force which is applied to shaft 145. Rotation of cocking lever 188 with respect to shaft 145 adjusts the torsion spring force applied to shaft 145, which force affects the rate of rotation and acceleration of shaft 145 from the first position to the second position.

Figure 17:
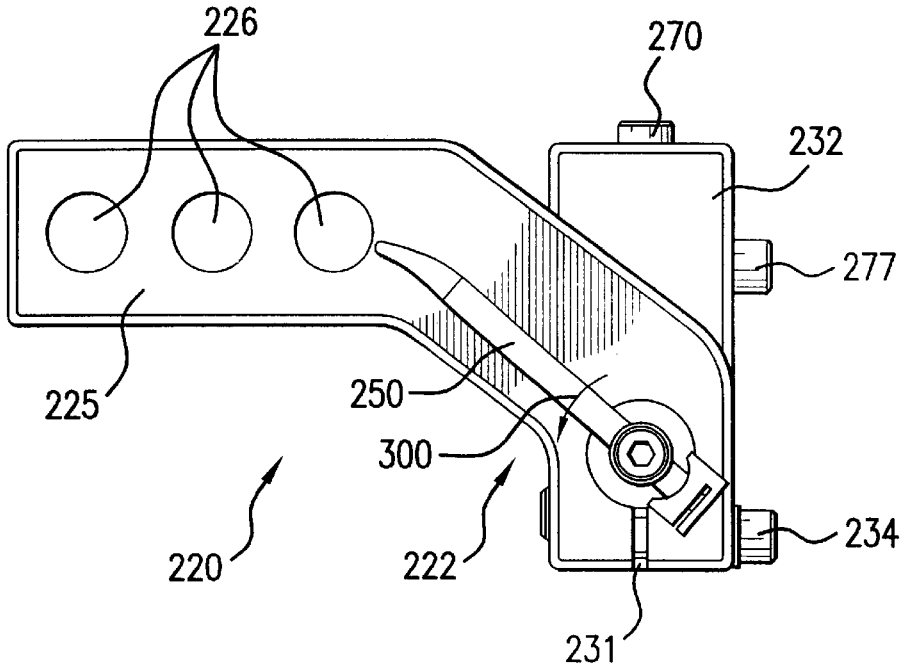
FIG. 17 is a side view of an apparatus for mounting an arrow rest with respect to an archery bow window, according to one preferred embodiment of this invention.
Figure 18:
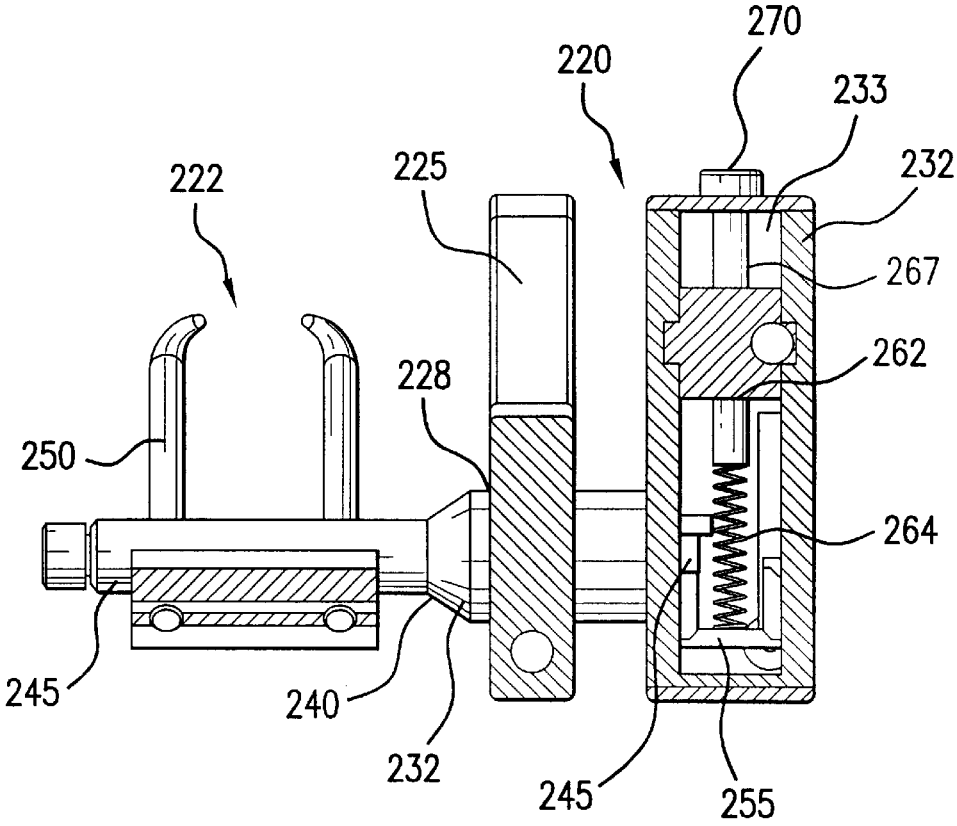
FIG. 18 is a partial sectional view, of an apparatus for mounting an arrow rest with respect to an archery bow window, taken along line A—A as shown in FIG. 15, according to one preferred embodiment of this invention.
Figure 19:
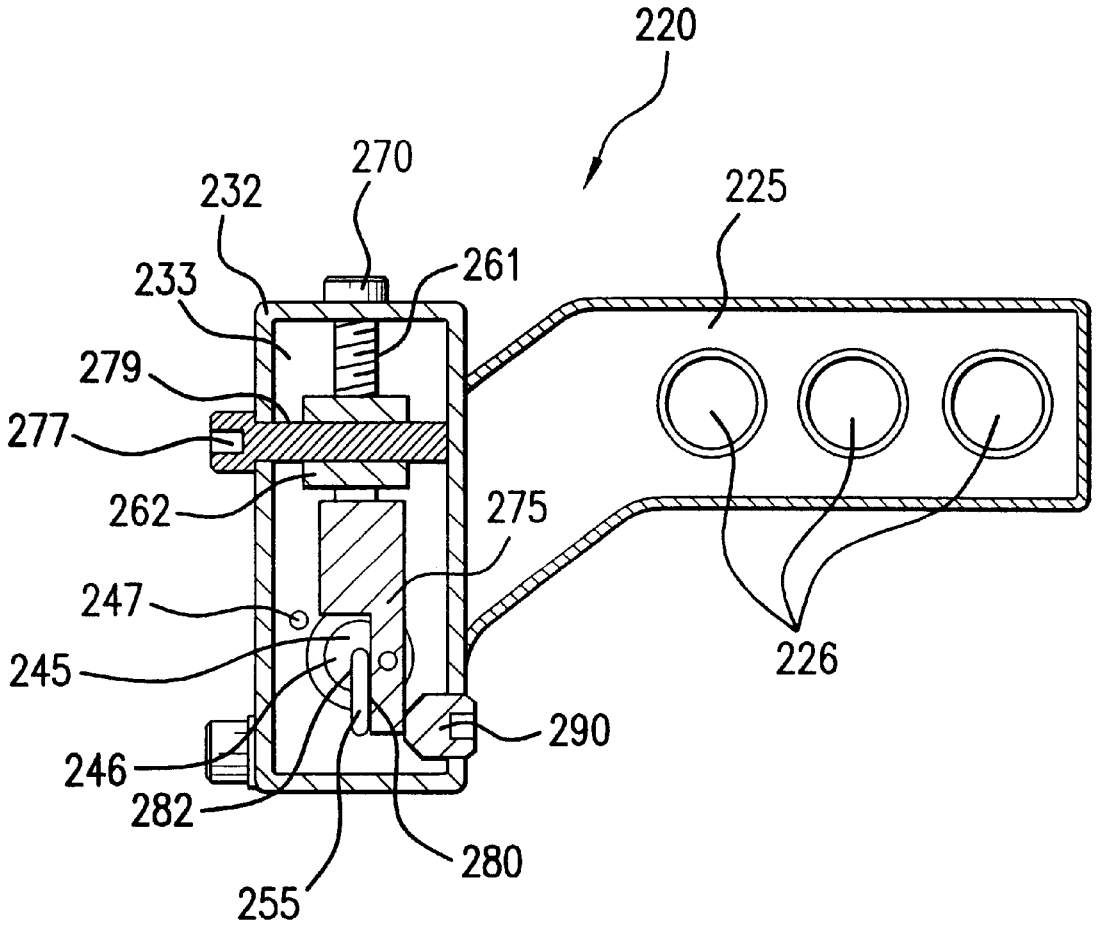
FIG. 19 is a partial sectional view, of an apparatus for mounting an arrow rest with respect to an archery bow window, taken along line B—B as shown in FIG. 16, according to one preferred embodiment of this invention.

In another preferred embodiment of this invention as shown in FIGS. 15–19, an apparatus 220 for mounting an arrow rest 222 with respect to an archery bow 221 and/or an archery bow window 224 comprises a support bracket 225. Support bracket 225 can have a general L-shape or any other suitable shape. As shown in FIGS. 17 and 19, support bracket 225 forms a plurality of apertures 226 for mounting support bracket 225 with respect to archery bow 221. Preferably, but not necessarily, at least one of apertures 226 is threaded for mating engagement with a threaded fastener, such as a screw or bolt, that can be used to secure arrow rest 222 to or against archery bow 221. Support bracket 225 further forms a mounting bore 228.

In one preferred embodiment of this invention, a housing is fixed with respect to archery bow window 224. For example, a bearing housing 232 may be connected directly or indirectly to support bracket 225. In one preferred embodiment of this invention, bearing housing 232 is integrated with support bracket 225. Preferably, bearing housing 232 is positioned within mounting bore 228. In one embodiment of this invention, support bracket 225 forms a slit or opening 231, as shown in FIG. 17. Preferably, a fastener 234, for example a screw or bolt, is threadedly engageable with a threaded bore formed in support bracket 225 transverse to mounting bore 228. Bearing housing 232 is secured within mounting bore 228 by rotation of fastener 234, whereby opening 231 narrows and at least a portion of a surface forming mounting bore 228 contacts bearing housing 232. Preferably with support bracket 225 secured to archery bow 221, a windage position and/or an elevation position of arrow rest 222 with respect to support bracket 225 is adjustable by sliding and/or rotating bearing housing 232 relative to support bracket 225.

In one preferred embodiment of this invention, an arrow shaft support member 230 is mounted with respect to bearing housing 232 and moveable between a first or arrow loading position and a second or actuated position. In one preferred embodiment of this invention, bearing housing 232 forms a bore 240 along a longitudinal axis of bearing housing 232 which is preferably coaxially aligned with a longitudinal axis 223 of apparatus 220. Preferably, but not necessarily, bore 240 is cylindrical and has a generally circular cross-section. Bore 240 may have any suitable cross-sectional shape and/or cross-sectional area.

A shaft 245 is mounted with respect to bearing housing 232. For example, shaft 245 may be positioned within bore 240 and extend along longitudinal axis 223. Preferably, shaft 245 is rotatably mounted within bore 240 and rotatable between a first or arrow loading position and a second or actuated position. At least a portion of shaft 245 extends into a cavity 233 formed by bearing housing 232, as shown in FIGS. 18 and 19. Shaft 245 forms at least one interference surface. Preferably as shown in FIG. 19, shaft 245 forms a first interference surface 280 and a second interference surface 282 each extending radially from a longitudinal axis of shaft 245, which is coaxially aligned with longitudinal axis 223. Preferably, but not necessarily, first interference surface 280 and said second interference surface 282 each is formed at an end surface 246 of shaft 245.

As shown in FIGS. 15–18, for example, arrow rest 222 further comprises at least one prong 250 attached or connected to a first end portion of shaft 245. Preferably, two prongs 250 are each connected to shaft 245 using fastening means well known to those having ordinary skill in the art, for example a screw or a bolt. Alternatively, prongs 250 may be formed or integrated with shaft 245. Prongs 250 preferably rotate with or as a function of shaft 245.

In one preferred embodiment of this invention, a stirrup 255 is operatively coupled with arrow shaft support member 230 and operatively mounted with respect to archery bow window 221. In one preferred embodiment of this invention, stirrup 255 is operatively mounted or connected to shaft 245. Preferably, but not necessarily, stirrup 255 is mounted or connected to an end portion of shaft 245 which extends into cavity 233, as shown in FIGS. 18 and 19. In one embodiment of this invention, stirrup 255 is rigidly connected to shaft 245 so that stirrup 255 rotates as shaft 245 rotates. Alternatively, as shown in FIGS. 18 and 19, stirrup 255 is pivotally connected to shaft 245 at one end portion of stirrup 255 and pivotally connected to bearing housing 232 at a second end portion for rotation of stirrup 255 independently of shaft 245. Preferably, stirrup 255 has a general "horseshoe" shape. For example, stirrup 255 may have a "U" shape, a "V" shape, or a square "U" shape, as shown in FIG. 18. Stirrup 255 may have any suitable shape which allows stirrup 255 to pivot with respect to shaft 245 in response to a force applied to stirrup 255.

A bias element 264, for example an extension spring or other suitable bias element known to those having ordinary skill in the art, is attached or connected at a first end portion to stirrup 255 and at a second end portion to an adjustment block 262, as shown in FIG. 18. Adjustment block 262 is slidingly positioned within bearing housing 232 and moveable in at least one direction, for example in a generally vertical direction, i.e. generally perpendicular to longitudinal axis 223. Preferably, adjustment block 262 is also moveable in a second direction, for example in a generally horizontal or lateral direction, parallel to longitudinal axis 223. Bias element 264 urges stirrup 255 toward an inertial mass 275 positioned within bearing housing 232, as shown in FIG. 19. Referring to FIG. 19, with shaft 245 in the first position, stirrup 255 is moveable between a first toggle position wherein stirrup 255 contacts first interference surface 280 and a second toggle position wherein stirrup 255 contacts second interference surface 282. In one preferred embodiment of this invention, a stopping block 290 is positioned within bearing housing 232 to maintain stirrup 255 in the first toggle position and prevent undesired rotation of shaft 245.

A cushion force adjustment means, for example a first adjustment screw 270 is threadedly engageable with a surface of adjustment block 262 forming a bore 267. Rotation of first adjustment screw 270 moves or linearly displaces adjustment block 262 in the generally vertical direction to adjust the position of adjustment block 262 relative to stirrup 255. Additionally, displacement of adjustment block 262 adjusts a bias force of bias element 264. The bias force initially maintains shaft 245 in the first or arrow loading position, wherein prongs 250 are positioned to accept and support archery arrow shaft 100. The bias force is adjustable to adjust a deflection or cushion force. The deflection or cushion force corresponds to a force required to deflect prongs 250 and actuate arrow rest 222, as discussed below.

A cushion distance adjustment means, for example a second adjustment screw 277 is threadedly engageable with a surface of adjustment block 262 forming a threaded bore 279, as shown in FIG. 19. Rotation of second adjustment screw 277 allows lateral adjustment of the second end portion of bias element 264 with respect to the first end portion of bias element 264 by a movement or displacement of adjustment block 262 in a generally horizontal direction, left-to right as shown in FIG. 19. An angle at which bias element 264 applies the bias force to stirrup 255, as well as a deflection or cushion distance of bias element 264, can be adjusted by rotation of second adjustment screw 277. The deflection or cushion distance defines a rotational distance, typically measured in degrees, which prongs 250 travel before the arrow rest 222 is actuated. The deflection or cushion distance corresponds to a distance which stirrup 255 must travel to move from the first toggle position to the second toggle position.

Referring to FIG. 17, in one preferred embodiment of this invention, arrow rest 222 and prongs 250 are initially positioned in the first or arrow loading position to accept and support archery arrow shaft 100. Arrow rest 222 can be adjusted for elevation and centershot, as discussed above. Archery bow 221 may provide a slight downward component to a movement of the archery arrow after release of the archery arrow from archery bow 221. As a result of the downward movement of the archery arrow, archery arrow shaft 100 urges prongs 250 forward in a downward rotational direction, as shown by arrow 300 in FIG. 17. As stirrup 255 moves relative to the second end portion of bias element 264, a force vector of bias element 264 causes stirrup 255 to accelerate in a clockwise direction, as shown in FIG. 19. With stirrup 255 in the second toggle position, shaft 245 rotates until shaft 245 and/or stirrup 255 contacts a projection or stop pin 247 integrated with, formed into or connected to an inner surface of bearing housing 232. Stop pin 247 limits the rotational movement of shaft 245 within bore 240. For example, shaft 245 rotates within bore 240 to the second position wherein stirrup 255 contacts stop pin 247, thus preventing shaft 245 from further rotation within bearing housing 232.

The movement from the first toggle position to the second toggle position allows a mass of stirrup 255 to be relatively low so that the force vector changes rapidly. This improves the response of shaft 245 and prongs 250. Conversely, in one embodiment of this invention wherein stirrup 255 is rigidly connected or mounted to shaft 245, stirrup 255 will not toggle and the force vector initially changes slowly due to the small angle and small effective force and the comparatively large mass of shaft 245 and prongs 250.

Arrow rest 222 may also be actuated to move from the first position to the second position by inertial mass 275. If the archery arrow does not have a downward component to its movement, archery arrow shaft 100 will not force prongs 250 in a forward direction and, thus, stirrup 255 and shaft 245 will not rotate initially. Inertial mass 275 will remain stationary during the release of the archery arrow. Recoil of archery bow 221 toward the archer's palm results in relative movement between inertial mass 275 and stirrup 255. Because arrow rest 222 moves toward stationary inertial mass 275, stirrup 255 is forced to move relative to adjustment block 262 positioned at the second end portion of bias element 264. Once the force vector of the second end portion of bias element 264 relative to stirrup 255 moves from a counterclockwise direction to a clockwise direction, arrow rest 222 moves as described above.

In one preferred embodiment of this invention, in order to return shaft 245, as well as prongs 250, to the first or arrow loading position from the actuated position, a cocking lever 288, operatively connected to shaft 245, is rotated until stirrup 255 contacts first interference surface 280 and inertial mass 275 in the first toggle position.

In one embodiment of the invention, a torsion spring (not shown) is positioned about at least a portion of a periphery of shaft 245 and a first end portion of the torsion spring is secured to shaft 245 by means known to those having ordinary skill in the art. For example, the first end portion may be inserted into an aperture formed by shaft 245 to secure the torsion spring to shaft 245. A second end portion of the torsion spring is secured to cocking lever 288. Preferably, but not necessarily, the second end portion is inserted into an aperture formed by an interior surface of cocking lever 288 for securing the torsion spring to cocking lever 288. Other means known to those skilled in the art may be used to secure the torsion spring to shaft 245 and/or cocking lever 288.

Cocking lever 288 provides a means for adjusting a torsion spring force which is applied to shaft 245. Rotation of cocking lever 288 with respect to shaft 245 adjusts the torsion spring force applied to shaft 245, which force affects the rate of rotation and acceleration of shaft 245 from the first position to the second position.

Figure 20:
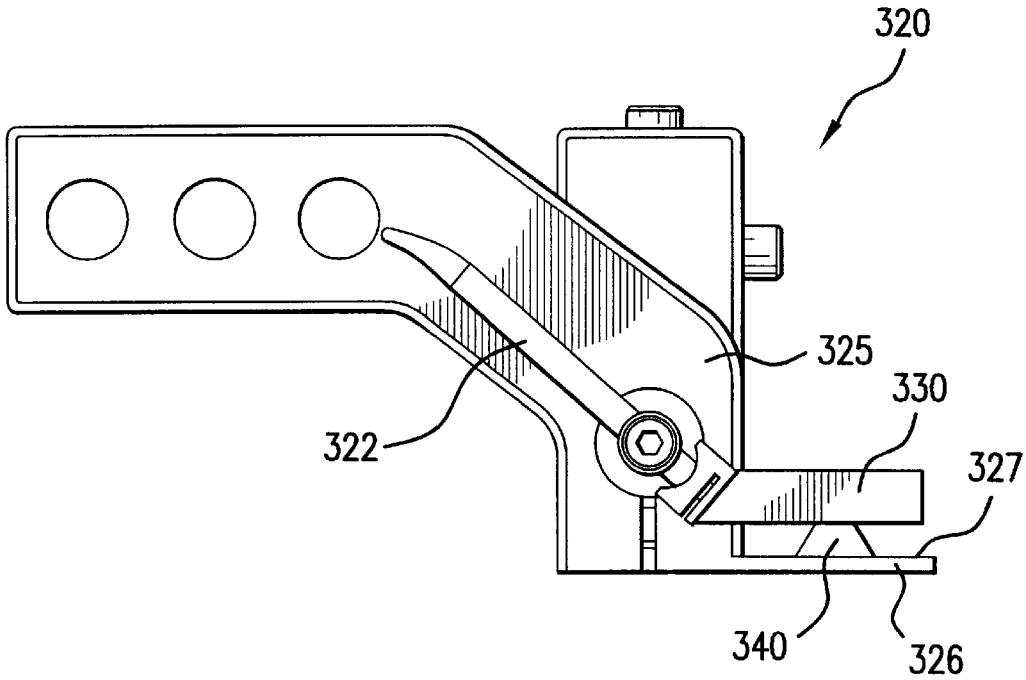
FIG. 20 is a side view of an apparatus for mounting an arrow rest with respect to an archery bow window, according to one preferred embodiment of this invention.

In another preferred embodiment of this invention as shown in FIG. 20, an apparatus 320 for mounting an arrow rest 322 with respect to an archery bow having an archery bow window comprises a support bracket 325. A first support member 326 is connected to or integrated with support bracket 325. First support member 326 has an engagement surface 327. Preferably, but not necessarily, engagement surface 327 is generally flat. Engagement surface 327 may have any suitable surface.

Arrow rest 322 can accept and support archery arrow shaft 100. Preferably, a second support member 330 is integrated with or connected to arrow rest 322 and extends across at least a portion of engagement surface 327, as shown in FIG. 20. Second support member 330 comprises an engagement member 340, for example a plunger or a suction cup, which is removeably connectable to or engageable with engagement surface 327 to maintain arrow rest 322 in a first or arrow loading position. Engagement member 340 supplies a force to maintain arrow rest 322 in the arrow loading position when archery arrow shaft 100 is loaded or positioned on arrow rest 322. It is apparent to one having ordinary skill in the art that engagement member 340 may alternatively be connected to first support member 326 and removeably engageable with second support member 330.

In one preferred embodiment of this invention, upon release of the archery arrow, engagement member 340 is disengaged from engagement surface 327 and arrow rest 322 is actuated to move to a second or actuated position.

Figure 21:
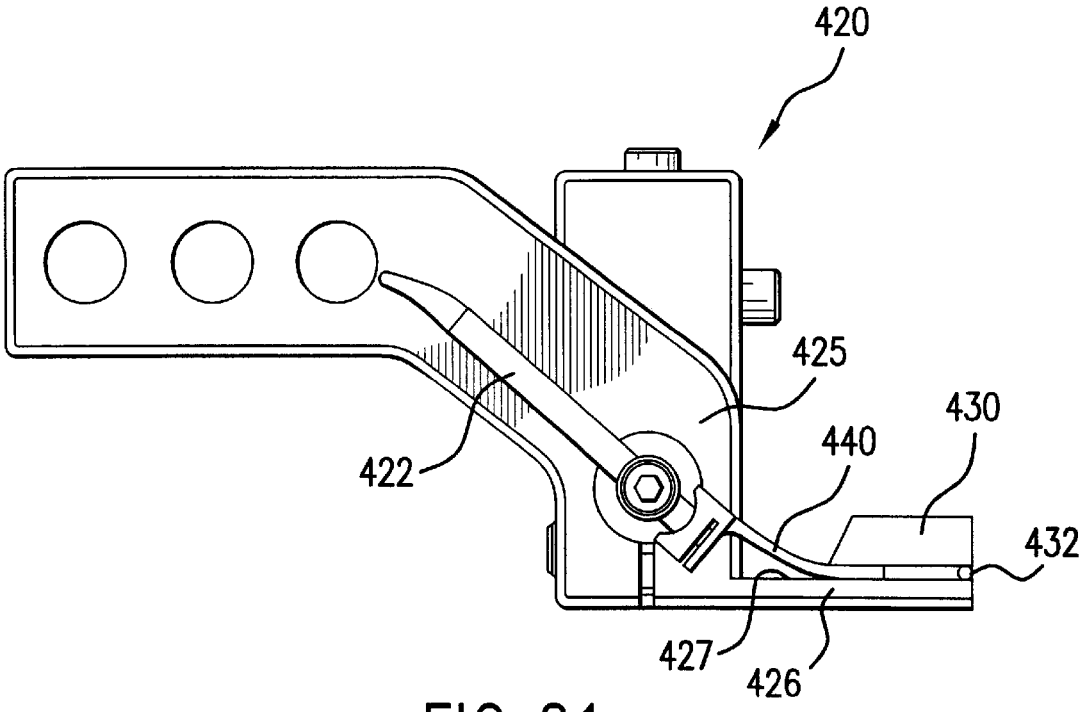
FIG. 21 is a side view of an apparatus for mounting an arrow rest with respect to an archery bow window, according to one preferred embodiment of this invention.

In another preferred embodiment of this invention as shown in FIG. 21, an apparatus 420 for mounting an arrow rest 422 with respect to an archery bow having an archery bow window comprises a support bracket 425. A first support member 426 is connected to or integrated with support bracket 425. A second support member 430 is integrated with or connected to first support member 426, as shown in FIG. 21. Preferably, but not necessarily, second support member 430 is hingedly or pivotally attached to first support member 426.

Arrow rest 422 can accept and support archery arrow shaft 100. Preferably, an extension member 440 is integrated with or connected to arrow rest 422 and extends from a distal end portion of arrow rest 422, as shown in FIG. 21. Extension member 440 may comprise a leaf spring, a resilient cantilever member or any other suitable member. At least a portion of a first surface of extension member 440 contacts a surface 427 of first support member 426. Second support member 430 contacts at least a portion of a second surface of extension member 440.

A force applied to extension member 440 by first support member 426 and/or second support member 430 maintains arrow rest 422 in the first or arrow loading position when archery arrow shaft 100 is loaded or positioned on arrow rest 422.

In one preferred embodiment of this invention, upon release of the archery arrow, extension member 440 is disengaged from first support member 426 and second support member 430 and arrow rest 422 is actuated to move to a second or actuated position.

In several drawings showing cross-sectional views of various embodiments of this invention, cross-hatching may indicate that various elements of this invention comprise a particular material. However, it is apparent to those skilled in the art that the elements may comprise any suitable material, including but not limited to metals, alloys, plastics, graphite materials and composite materials.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. An apparatus for mounting an arrow rest with respect to an archery bow window, the arrow rest being moveable in response to a movement of an arrow shaft, the apparatus comprising:

a bearing housing fixed with respect to said archery bow window;

a shaft mounted with respect to said bearing housing, said shaft moveable between a first position and a second position;

a cam operatively moveable with said shaft;

a follower contacting said cam in said first position;

a first bias element urging said follower in contact with said cam; and a second bias element urging said shaft from said first position to said second position.

2. The apparatus of claim 1 wherein said bearing housing is integrated with an archery bow.

3. The apparatus of claim 1 further comprising a support bracket mounted with respect to said archery bow window.

4. The apparatus of claim 3 wherein said bearing housing is integrated with said support bracket.

5. The apparatus of claim 1 wherein said bearing housing forms a bore, and said shaft is rotatably mounted within said bore.

6. The apparatus of claim 5 wherein said bore is cylindrical.

7. The apparatus of claim 1 wherein said follower comprises one of a ball bearing, a plunger, a roller and a wheel.

8. The apparatus of claim 1 wherein said follower is at least partially positioned within an aperture formed by said bearing housing.

9. The apparatus of claim 1 wherein said first bias element comprises a spring.

10. The apparatus of claim 1 further comprising an adjusting element positioned within a bore formed by a support bracket and said adjusting element contacting and moving said first bias element.

11. The apparatus of claim 1 further comprising a cap rotationally connected to said bearing housing.

12. The apparatus of claim 11 wherein a first end portion of said second bias element is operatively connected to said shaft and a second end portion of said second bias element is operatively connected to said cap.

13. The apparatus of claim 11 wherein said second bias element comprises a torsion spring positioned about at least a portion of a periphery of said shaft, a first end portion of said torsion spring connected to said shaft and a second end portion of said torsion spring connected to said cap.

14. The apparatus of claim 1 wherein said cam is integrated with said shaft.

15. The apparatus of claim 1 wherein said cam comprises a first cam surface.

16. The apparatus of claim 15 wherein said first cam surface has a variable cam surface profile.

17. The apparatus of claim 1 wherein said cam further comprises at least one boundary between a first cam surface and a second cam surface of said cam.

18. The apparatus of claim 17 wherein said boundary is formed by a transition surface.

19. The apparatus of claim 1 wherein a bias force of said first bias element is adjustable.

20. An apparatus for mounting an arrow rest with respect to an archery bow window, said arrow rest moveable in response to a movement of an arrow shaft, the apparatus comprising:

a housing fixed with respect to said archery bow window;

an arrow shaft support member moveable between a first position and a second position;

a cam operatively coupled with said arrow shaft support member, said cam operatively moveable with respect to said archery bow window;

a follower contacting said cam in said first position; and a first bias element urging said follower in contact with said cam in said first position.

21. The apparatus of claim 20 further comprising a second bias element urging said arrow shaft support member from said first position to said second position.

22. The apparatus of claim 20 wherein said arrow shaft support member comprises a shaft operatively connected to said cam, and said shaft rotates between said first position and said second position.

23. The apparatus of claim 20 wherein said cam is integrated with said arrow shaft support member.

24. The apparatus of claim 20 wherein said cam comprises a first cam surface, and said first cam surface has a variable cam surface profile.

25. The apparatus of claim 24 wherein said first cam surface transitions into a periphery of a shaft operatively connected to said cam.

26. The apparatus of claim 20 wherein said housing is mounted with respect to a support bracket, and said support bracket is mounted with respect to said archery bow window.

27. The apparatus of claim 20 further comprising an archery bow, and said housing is integrated with said archery bow.

28. An apparatus for mounting an arrow rest with respect to an archery bow window, said arrow rest moveable in response to a movement of an arrow shaft, the apparatus comprising:

a bearing housing fixed with respect to said archery bow window, said bearing housing forming a bore;

a shaft rotatably mounted within said bore, said shaft rotatable between a first position and a second position;

a cam having a first cam surface, said cam operatively moveable with said shaft;

a follower contacting said first cam surface in said first position; and a first bias element urging said follower in contact with said first cam surface.

29. The apparatus of claim 28 further comprising a support bracket forming a mounting bore, and said bearing housing mounted within said mounting bore.

30. The apparatus of claim 29 wherein said cam is adjustably positionable laterally with respect to said support bracket.

31. The apparatus of claim 28 further comprising a transition surface positioned between said first cam surface and a periphery of said shaft.

32. The apparatus of claim 28 wherein said first cam surface comprises at least one of a convex surface, a concave surface and a flat surface.

33. The apparatus of claim 28 wherein said first bias element has an adjustable bias force, and said adjustable bias force urges said follower in contact with said first cam surface.

34. The apparatus of claim 28 further comprising a second bias element urging said shaft from said first position to said second position.

35. The apparatus of claim 28 wherein said arrow rest comprises two prongs mounted to a first end portion of said shaft and rotatable with said shaft.

36. The apparatus of claim 28 wherein said follower comprises a ball bearing at least partially positioned within an aperture formed by said bearing housing, and said ball bearing contacting said first cam surface in said first position and contacting a second cam surface in said second position.

37. An apparatus for mounting an arrow rest with respect to an archery bow, said arrow rest moveable in response to a movement of an arrow shaft, the apparatus comprising:

a support bracket secured with respect to said archery bow;

a bearing housing connected to said support bracket, said bearing housing forming a bore;

a shaft positioned within said bore, said shaft rotatable between a first position and a second position;

a cam having a first cam surface, said first cam surface transitioning into a second cam surface;

at least one prong operatively connected to and rotatable with a first end portion of said shaft;

a ball bearing at least partially positioned within an aperture formed by said bearing housing, said ball bearing contacting said first cam surface in said first position and contacting said second cam surface in said second position;

a spring contacting said ball bearing, said spring urging said ball bearing against said cam;

a cap rotatably connected to said bearing housing; and a spring positioned about a periphery of a second end portion of said shaft, a first end portion of said spring connected with respect to said shaft and a second end portion of said spring connected with respect to said cap.

* * * * *